US009616674B2

(12) United States Patent
De Saint Romain

(10) Patent No.: US 9,616,674 B2
(45) Date of Patent: Apr. 11, 2017

(54) INK CIRCUIT FOR PIGMENT INKS

(71) Applicant: Markem-Imaje Holding, Bourg les Valence (FR)

(72) Inventor: Pierre De Saint Romain, Valence (FR)

(73) Assignee: MARKEM-IMAJE HOLDING, Bourg-les-Valence (FR)

( * ) Notice: Subject to any disclaimer, the term of this patent is extended or adjusted under 35 U.S.C. 154(b) by 0 days.

(21) Appl. No.: 14/857,125

(22) Filed: Sep. 17, 2015

(65) Prior Publication Data

US 2016/0082746 A1 Mar. 24, 2016

(30) Foreign Application Priority Data

Sep. 18, 2014 (FR) ..... 14 58808

(51) Int. Cl.
*B41J 2/175* (2006.01)
*B41J 2/18* (2006.01)

(52) U.S. Cl.
CPC ..... *B41J 2/18* (2013.01); *B41J 2/175* (2013.01); *B41J 2/17513* (2013.01)

(58) Field of Classification Search
CPC . B41J 2/18; B41J 2/175; B41J 2/17513; B41J 2/195
See application file for complete search history.

(56) References Cited

U.S. PATENT DOCUMENTS 6,312,113 B1 11/2001 Murad
8,371,684 B2 2/2013 Smith
8,529,032 B2 * 9/2013 Indorsky ..... B41J 2/19 347/86
2004/0066432 A1 4/2004 Hatada
2005/0057627 A1 3/2005 De Marco
2012/0026258 A1 2/2012 Leighton
2012/0194619 A1 8/2012 Smith
2014/0050868 A1 2/2014 De Saint-Romain
(Continued)

FOREIGN PATENT DOCUMENTS

CN 102729640 B 7/2014
FR 2 618 728 A1 2/1989
(Continued)

OTHER PUBLICATIONS

Search Report issued in French Patent Application No. FR 14 58808 dated May 8, 2015.
(Continued)

*Primary Examiner* — Geoffrey Mruk
(74) *Attorney, Agent, or Firm* — Pearne & Gordon LLP

(57) ABSTRACT

The invention relates to a reservoir for a pigment ink for a continuous inkjet printer comprising: at least a convergent shaped part, converging towards a portion that comprises an ink flow orifice, the tangent to a wall of said convergent shaped part forming an angle from the horizontal equal to more than about 30° and less than 90°, when the reservoir is in its usage position, a recirculation circuit to transferring some of the ink from said convergent shaped part, and bring it back into the reservoir, through at least one transferred liquid outlet means located above the maximum ink level in the reservoir, a circuit to drawing off ink and transferring the ink thus drawn off to a print head.

29 Claims, 5 Drawing Sheets

(56) References Cited

U.S. PATENT DOCUMENTS

2014/0065381 A1 3/2014 De Saint Romain

FOREIGN PATENT DOCUMENTS

| | | | |
|---|---|---|---|
| GB | 2 455 775 | A | 6/2009 |
| JP | 2001-071532 | A | 3/2001 |
| JP | 2006-045359 | A | 2/2006 |
| JP | 2010-052150 | A | 3/2010 |
| KR | 2010-0042447 | A | 4/2010 |
| KR | 1020100042447 | A | 4/2010 |
| WO | 91/04862 | A1 | 4/1991 |
| WO | 97/09176 | A1 | 3/1997 |
| WO | 02/096654 | A1 | 12/2002 |
| WO | 2004/078352 | A2 | 9/2004 |

OTHER PUBLICATIONS

Utility U.S. Appl. No. 14/763,927, "Ink Composition for Liquid Jet Printing", filed Jul. 28, 2015.
Utility U.S. Appl. No. 14/844,532, "A Method for Managing Ink Quality of an Inkjet Printer versus Temperature" filed Sep. 3, 2015.
Written Opinion and Search Report issued in Application No. EP 15 18 5850 dated Feb. 17, 2016.
Machine Translation of Japanese Patent Publication No. 2006-045359 dated Feb. 16, 2006.
Machine Translation of Japanese Patent Publication No. 2010-052150 dated Mar. 11, 2010.
Machine Translation of Chinese Patent No. 102729640 dated Jul. 9, 2014.

* cited by examiner

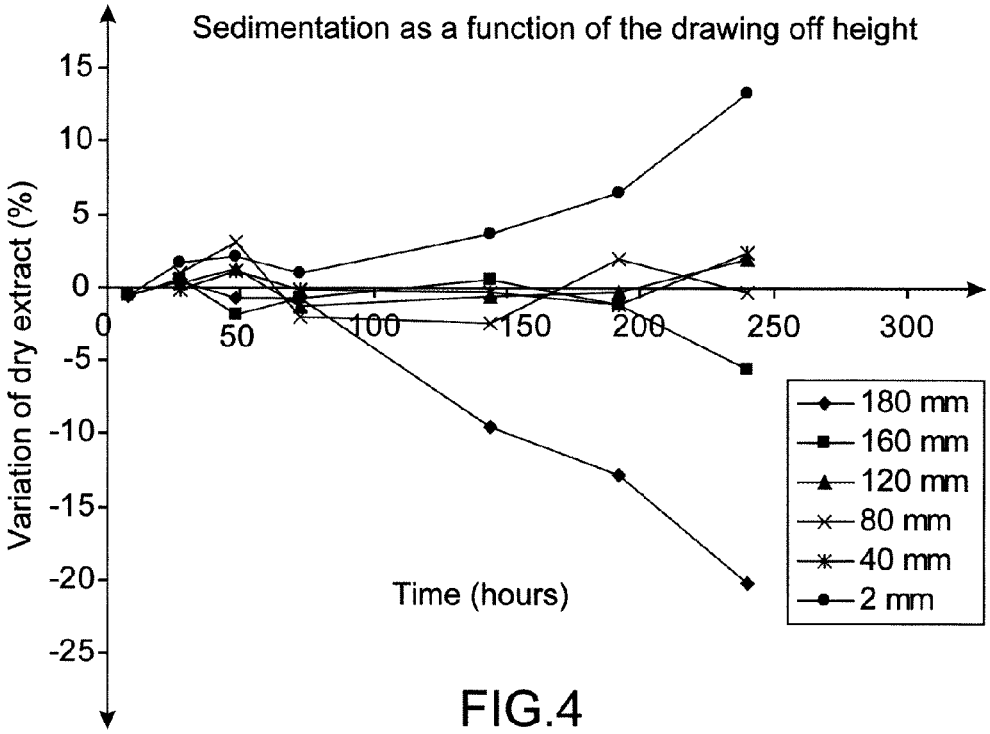
FIG.4
FIG.5
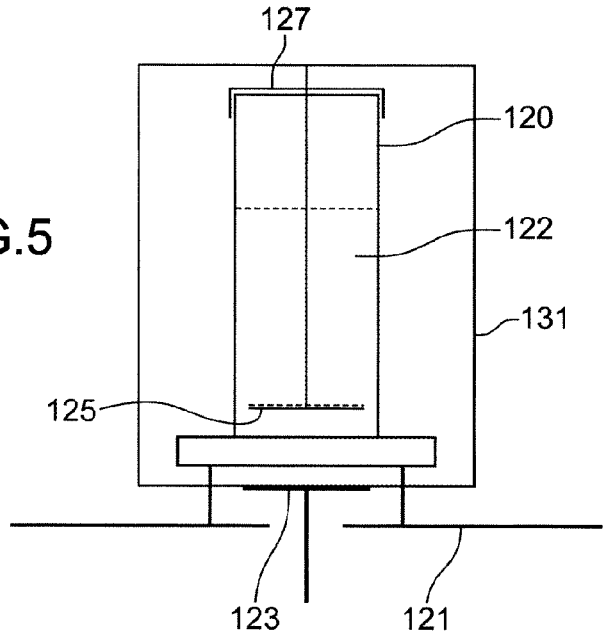

INK CIRCUIT FOR PIGMENT INKS

TECHNICAL FIELD AND PRIOR ART

The invention relates to the domain of continuous inkjet printers (CIJ).

It also relates to the architecture (the layout of the ink circuit) of CIJ printers, particularly in order to guarantee homogeneity of the ink.

It also relates to a means of extending the functional domain of the circuit to inks containing dense pigments.

Continuous inkjet (CIJ) printers are well known in the field of coding and industrial marking of various products, for example for high speed marking of barcodes, expiration dates on food products or references or distance marks on cables or pipes directly on the production line. This type of printer is also used in some decoration domains in which the technological possibilities of graphic printing are exploited.

These printers have several subassemblies of the type shown in FIG. 1.

Firstly, a print head 1 usually offset from the body of the printer 3, is connected to the body through a flexible umbilical line 2 including hydraulic and electrical connections necessary for operation of the head by giving it flexibility that facilitates integration on the production line.

The body of the printer 3 (also called the cabinet) usually comprises three subassemblies:

- an ink circuit in the bottom part of the cabinet (zone 4'), that firstly supplies a suitable quality ink to the head at a stable pressure, and secondly makes it possible to handle ink from jets that is not used for printing,
- a controller located in the top of the cabinet (zone 5'), capable of managing action sequences and performing treatments for activation of different functions of the ink circuit and the head.
- an interface 6 that provides the operator with the means of using the printer and being informed about its operation.

In other words, the cabinet comprises 2 subassemblies: the electronics and the electrical power supply and the operator interface at the top, and an ink circuit supplying nominal quality ink to the head at positive pressure and recovering ink not used by the head at negative pressure, at the bottom.

FIG. 2 diagrammatically shows a print head 1 of a CIJ printer. It comprises a drop generator 60 supplied with pressurised electrically conducting ink by the ink circuit 4.

This generator is capable of emitting at least one continuous jet through a small dimension orifice called the nozzle. The jet is transformed into a regular sequence of identical size drops under the action of a periodic stimulation system (not shown) on the upstream side of the nozzle outlet. When the drops 7 are not to be used for printing, they are directed towards a gutter 62 that recovers them so as to recycle unused ink by returning the drops to the ink circuit 4. Devices 61 placed along the jet (charge and deflection electrodes) electrically charge the drops on order and deflect them in an electrical field Ed. These drops are then diverted from their natural ejection trajectory from the drop generator. The drops 9 intended for printing are not directed to the gutter and are deposited on the support to be printed 8.

This description can be applied to continuous inkjet (CIJ) printers called binary printers or continuous multi-deflected jet printers. Binary CIJ printers are fitted with a head in which the drop generator has a multitude of jets, each drop in a jet can only be oriented towards only two trajectories, namely print or recovery. In multi-deflected continuous jet printers, each drop in a single jet (or a few spaced jets) may be deflected on different trajectories corresponding to charge commands that are different from one drop to the next, thus scanning the zone to be printed along a direction that is the deflection direction, the other scanning direction of the zone to be printed is covered by a relative displacement of the print head and the support to be printed 8. In general, the elements are arranged such that these 2 directions are approximately perpendicular.

An ink circuit of a continuous inkjet printer supplies firstly ink at regulated pressure, and possibly solvent, to the drop generator of the head 1 and creates a negative pressure to recover fluids not used for printing in return from the head.

It also manages consumables (ink and solvent distribution from a chamber) and controls and maintains the ink quality (viscosity/concentration).

Finally, other functions are related to user comfort and to the automatic handling of some maintenance operations in order to guarantee identical operation regardless of usage conditions. These functions include rinsing of the head with solvent (drop generator, nozzle, gutter), assistance with preventive maintenance such a replacement of limited life components (filters, pumps).

These various functions have very different purposes and technical requirements. They are activated and sequenced by the printer controller 5 that will be more complex if there is a large number of sophisticated functions.

Inks containing pigments such as titanium oxide (rutile $TiO_2$ or anatase) in the form of sub-micronic size particles are particularly attractive for their whiteness and their opacity. They are used for marking and identification of black or dark supports. Dense pigment particles naturally tend to sediment when ink is at rest. The consequences of this inevitable sedimentation can be blocking of pipes or loss of opaqueness of markings. Therefore the ink circuit must be able to stir ink in one way or another such that the ink can maintain its homogeneity, or restore it after a fairly long rest time.

Another difficulty related to the ink quality is the presence of foam in the ink reservoir into which unprinted ink recovered by the print head gutter is returned. This foam is created by the inevitable intake of air with ink recovered through the gutter. In particular, water-based inks foam more than solvent-based inks. This air is evacuated through a vent. It is important that the ink circuit can defoam the ink sufficiently quickly to avoid creating an ink overflow through the vent. The question of recycling air mixed with ink to the head also arises.

In the specific domain of inkjet printers, solutions have been disclosed to satisfy needs related to the presence of dense pigments in inks.

One example of a device for management of these particular difficulties specific to inks containing dense pigments is given in patent WO9104862. This device uses magnetic stirrers to keep ink homogeneous in the 2 reservoirs. A magnetic bar placed at the bottom of the reservoir is moved by the rotating magnetic field of a magnet moved by a motor under the reservoir. These stirrers must remain permanently in operation, even when the printer is stopped. The assembly also comprises a third reservoir containing ink under pressure that is not permanently homogenised and that has to be emptied before the printer is stopped. These systems are also expensive, complex and comprise mechanical elements subject to wear. The magnetised bar is also subject to wear in time due to contact with more or less abrasive pigments.

Finally, the magnetic field can disturb other devices including the system, for example all RFID type identification systems.

U.S. Pat. No. 6,312,113 describes a removable reservoir with a flat bottom in which the ink is sucked in through a tube arriving through the inside of the reservoir to near the bottom through one or several orifices placed at different locations in the bottom, pumped and discharged vertically inside the reservoir through another tube. In such a system, the flat bottom requires that the ink intake from the bottom takes place at several locations in order to avoid sedimentation at several locations. The large number of sampling points requires a high pumping speed such that the velocity of the fluid at the intake is sufficiently high to prevent sedimentation or even to restore homogeneity after the pump has stopped. Recirculation of the ink and its arrival vertically above the liquid or in the liquid is not favourable to homogeneity of the ink over the entire surface and over the entire depth of the liquid.

U.S. Pat. No. 8,371,684 discloses an ink circuit of an inkjet printer for which the reservoir has a cylindrical part and a conical part terminated by a flat bottom with a diameter of about 25 mm. Ink is drawn off close to the bottom and is discharged at a higher level, inside the liquid, through pipes inside the reservoir. Since the horizontal surface of the bottom of the reservoir is not negligible, pigments can sediment on this surface. Ink is homogenised by pumping that can be alternated between 2 pipes. The position of the end of the return pipe at a distance of 25 to 50 mm from the bottom surface is not conducive to perfect homogenisation of ink over the entire depth of the liquid.

In general, the ink circuit of known inkjet printers capable of projecting dense pigment inks remains a costly element due to the large number of hydraulic components to be installed.

Therefore the problem arises of making some or all of the functions of an ink circuit in a CIJ type printer at low cost with a reduced number of components while guaranteeing minimum reliability, or in any case reliability expected by users, particularly related to homogeneity of pigment inks throughout consumption. Therefore a search is made to use the simplest possible components, particularly for functions such as controlling and maintaining the ink quality. This ink quality may be defined in terms of viscosity and/or concentration of the ink.

One particular problem is to reduce or to limit the variation in the opaqueness of the ink as a function of the ink consumption. The opaqueness of marking is related essentially (but not only) to the pigment concentration. If some of the pigments settle to the bottom of the reservoir, the pigment concentration in the liquid ink will be reduced and the opaqueness will be reduced.

Another problem is to reduce or to minimise the time necessary for homogenisation of the ink before printing is restarted, after a possibly long shutdown of the machine.

According to another aspect, the ink circuit comprises a large number of hydraulic, hydro-electric components, sensors, etc. Modern printers have many sophisticated and precise functions. Hydraulic components (pumps, solenoid valves, self-closing connections, filters, miscellaneous sensors) are present or are designed to satisfy a level of quality, reliability, performance and service for the user. And maintenance functions consume components because they are often automated.

Therefore there is also a need for an ink circuit architecture that minimises the number of components while guaranteeing a good level of performance and reliability and ease of maintenance allowing fast actions, minimising risks of dirt and that can be done by operators without any special training.

PRESENTATION OF THE INVENTION

The invention relates firstly to a reservoir for a pigment ink for a continuous inkjet printer comprising:

- at least a convergent shaped part or a part delimited by a convergent shaped wall, said part converging towards a portion that comprises an ink flow orifice, or a part for which the section reduces or becomes smaller or decreases towards a portion that comprises an ink flow orifice,
- a recirculation circuit, or means, for transferring some of the ink from said part, towards at least one outlet, or outlet means, for example at least one orifice, of the transferred ink, located above the maximum ink level in the reservoir,
- a hydraulic circuit, or means, for drawing off some of the ink from the reservoir and transferring the ink thus drawn off to a print head.

This reservoir is thus configured, or comprises means, so that ink, drawn from said convergent shaped part, is brought back to the reservoir, through said at least one outlet means.

In particular, such a device can eliminate or limit the presence of foam in the ink reservoir into which unprinted ink recovered through the print head gutter is returned.

The transferred liquid outlet or outlet means, for example the orifice, may be located in the top third or quarter of the reservoir, for example at a maximum distance of 10 mm or 50 mm from the top or from the highest point of the reservoir when the reservoir is in operation.

The invention thus also relates to a reservoir for a pigment ink of a continuous inkjet printer comprising:

- at least one convergent shaped part or at least one part delimited by at least one convergent shaped wall, said part converging towards a portion that comprises an ink flow orifice, or a part for which the cross-section reduces or becomes smaller or decreases towards a portion that comprises an ink flow orifice,
- a recirculation circuit, or means, to transfer some of the ink from said part towards at least one outlet means, for example at least one orifice, of the transferred ink, located in the upper third or quarter of the reservoir, for example at a maximum distance of 10 mm or 50 mm from the top, or from the highest point of the reservoir, when it is in operation,
- a hydraulic circuit, or means for, drawing off some of the ink from the reservoir and transferring the ink thus drawn off to a print head.

Here again, this reservoir is thus configured, or comprises a circuit or means, so that ink, drawn from said convergent shaped part, is brought back to the reservoir, through said at least one outlet means.

In this description and in the claims the expression "convergent shaped part" or "convergent part" includes or covers at least one part delimited by at least one convergent shaped wall, or for which the cross-section reduces or becomes smaller or decreases.

Regardless of the embodiment, the convergent part may comprise a conical or tapered part in the form of an inverted pyramid or portion of an inverted pyramid. Preferably, the ink flow orifice is then located in the narrower or less wide part, or at the vertex or at the end of the conical or tapered or pyramid-shaped or inverted pyramid-shaped wall.

When the reservoir is in its usage position, the wall of said convergent part or its plane tangent to at least some of its points or at each of its points, or its tangent (at, at least, some of its points or at each of its points) in the vertical plane perpendicular to the wall, or the direction or the line defined by the intersection of said plane tangent to at least some of its points (or at each of its points) and said vertical plane perpendicular to the wall, can make an angle from the horizontal defined by the top surface of the ink equal to more than 30° (and less than 60° or 80°), or from the vertical or from a pigment sedimentation direction, equal to less than 60° (but more than 10° or 30°).

Thus, in the case of an inverted pyramid shaped wall or a portion of an inverted pyramid, the angle formed by the planes of the pyramid with the horizontal will preferably be more than 30°.

In the case of a conical or tapered wall, the angle at the vertex of the cone (angle made by the generating line of the conical or tapered part and the axis of the cone) will preferably be less than 60°.

Preferably, the wall of the convergent part does not have any surface perpendicular to a pigment sedimentation direction or to the vertical when the reservoir is in its usage position, or, more generally, does not have any surface forming an angle of more than 60° with a pigment sedimentation direction (the vertical direction) when the reservoir is in its usage position.

The ink flow orifice is advantageously located at the end of the convergent part.

The recirculation circuit, or means, to transfer some of ink, from said convergent part may include a pump that may be a single-directional pump. Its flow may be limited, for example to a flow of a few ml/minute, for example between 1 ml/minute and 5 ml/minute.

According to one embodiment, a single pump can firstly transfer some of the ink from said convergent part, to at least one transferred liquid outlet orifice located above the maximum ink level in the reservoir, and secondly draw off some of the ink and transfer the ink thus drawn off to a print head.

The circuit or means to draw off the ink and transfer the ink thus drawn off to a print head may comprise a pump dedicated to this drawing off and to this transfer.

Drawn off ink filter means, or at least a drawn off ink filter, may also be provided regardless of which embodiment is chosen.

Said recirculation circuit, or means, to transfer some of the ink may be located at least partly outside the reservoir and/or at least partly inside the reservoir.

Preferably, they enable a permanent transfer of ink even when no jet is ejected by the print head or when the print head is stopped.

Preferably, the circuit or means to draw off some of the ink are capable of drawing off:

- from said convergent part;
- and/or from an intermediate portion of the reservoir, for example located between:
  - a first level A, defined by the ink flow orifice or by a level located at not less than $1/20^{th}$ or $1/10^{th}$ or 1/4 or 1/3 of the height of the reservoir, measured between the lowest point of the reservoir and the highest point of the reservoir when the reservoir is in operation,
  - and a second level B defined by the upper third or quarter (in this case also measured as a proportion of the reservoir height H as explained above).

In this portion (between levels A and B), the concentration of pigment in the ink remains approximately constant and equal to the initial nominal concentration.

According to one embodiment, the circuit or means to draw off some of the ink and send it to the print head is/are designed so that ink can be drawn off vertically in line with the ink flow orifice, when the reservoir is in the usage position.

According to one advantageous embodiment, the recirculation circuit or the ink transfer means, for example the outlet orifice, can return ink above or at the surface of the ink present in the reservoir, along a direction perpendicular to a sedimentation direction of ink pigments.

In a variant, a reservoir according to the invention further comprises means, or an additional hydraulic circuit, for example one or more ducts and one or more pump, to inject an additional fluid or liquid, for example solvent, into said reservoir; alternatively, said means, or said additional hydraulic circuit, to inject an additional fluid can be connected to said recirculation circuit, or means, to transfer ink, thus adding said fluid into said recirculated ink before the recirculated ink is brought back to the reservoir, through said at least one outlet means.

The invention also relates to a method of recirculating pigment ink, making use of a reservoir like that described above.

The invention also relates to a continuous inkjet printer comprising:

- an ink circuit including a reservoir like that described above,
- a print head,
- hydraulic connection means or hydraulic connections to bring ink to be printed from the ink reservoir to the print head, and to send ink to be recovered from the print head to said ink circuit;
- electrical connection means or electrical connections.

The invention also relates to a method of printing using a continuous inkjet printer like that described above.

The invention also relates to a pigment ink recirculation method, for ink contained in an ink reservoir of an ink circuit of a continuous inkjet printer, this reservoir comprising at least one convergent part converging towards a portion that comprises an ink flow orifice and/or this reservoir being of the type described above, method in which some of the ink is transferred from said convergent part to an upper zone of the reservoir, at least one outlet means or outlet, for example at least one orifice, being located above the maximum ink level in the reservoir, for outlet of the transferred ink.

Ink, drawn from said convergent shaped part, is brought back to the reservoir, through said at least one outlet.

The convergent part may comprise a conical portion or a tapered portion shaped like an inverted pyramid or a portion of an inverted pyramid.

The wall of the convergent portion, or its plane tangent to at least some of its points or to each of its points, or its tangent (at, at least, some of its points or at each of its points), in the vertical plane perpendicular to the wall, or the direction or the line defined by the intersection of said plane tangent to at least some of its points (or at each of its points) and said vertical plane perpendicular to the wall, can form an angle from the horizontal defined by the upper surface of the ink equal to more than 30° (and less than 60° or 80°), or from the vertical, or from a pigment sedimentation direction equal to less than 60° (but more than 10° or) 30°.

Thus, in the case of an inverted pyramid-shaped wall, the angle formed by the planes of the pyramid with the horizontal will preferably be more than 30°.

And in the case of a conical or tapered wall, the angle formed by the cone (angle formed by a generating line of the conical or tapered part and the axis of the cone) will preferably be less than 30°.

With such a method, some of the ink can also be drawn off from the reservoir, for example from said convergent part, the ink thus drawn off being sent to a print head.

Part of the ink can also be drawn off from an intermediate portion of the reservoir in which the pigment density is most stable in time, the ink thus drawn off being sent to a print head; for example, this portion is located firstly above a level defined by the ink outlet or a level located at at least $1/20^{th}$ or $1/10^{th}$ or ¼ or ⅓ of the height of the reservoir measured from its lowest point, and secondly less than ¼ or ⅓ of the reservoir height measured from its highest point.

Advantageously, the outlet, or the outlet means of transferred ink, returns the ink to above or at the surface of ink present in the reservoir, horizontally relative to said surface.

Some of the ink may be transferred using a pump, for example pumping at a maximum flow of about 1 ml/minute or between about 1 ml/minute and 10 ml/minute. If the pump also sends ink to the print head, its transfer flow may be up to ½ l/min or even 1 l/min.

Some of the ink can be transferred even if there is no jet sprayed by the print head or even when the printer is stopped. This allows the printer to restart operation immediately after it is switched on, because this permanent ink transfer assures that the ink remains homogeneous. The result is an improvement in the productivity of the machine.

If there is no permanent transfer of ink from the bottom to the surface, it is possible to restart the printer immediately as soon as it is switched on again, without it being necessary to wait for homogenisation of the pigments; this is the case particularly if ink sent to the head is drawn off from the intermediate zone defined above, or at a distance of at least ⅓, or ¼, or 0.1/5, of the reservoir height above the bottom, measured from its lowest point.

Thus, some of the ink can be drawn off from said convergent part and can be sent to a print head before some of the ink is transferred, from said convergent part to an upper zone of the reservoir.

A method according to the invention can further comprise injecting an additional fluid or liquid, for example a solvent, into said reservoir, said added fluid being possibly mixed with said transferred ink, before passing through said at least one outlet means or outlet. Thus a mixture of recirculated ink and added fluid is introduced into the reservoir. A same pipe can be used to inject into the reservoir the mixture of recirculated ink and of added fluid.

A method according to the invention or a printer according to the invention can be a continuous inkjet printer (CIJ), for example of the binary type, or of the multi-deflected jet type.

BRIEF DESCRIPTION OF THE FIGURES

FIGS. 3-5 show tests performed for the purpose of this invention,

DETAILED PRESENTATION OF ONE EMBODIMENT

Firstly, some experiments performed by the inventors will be presented in order to facilitate understanding of the invention.

Figure 3:
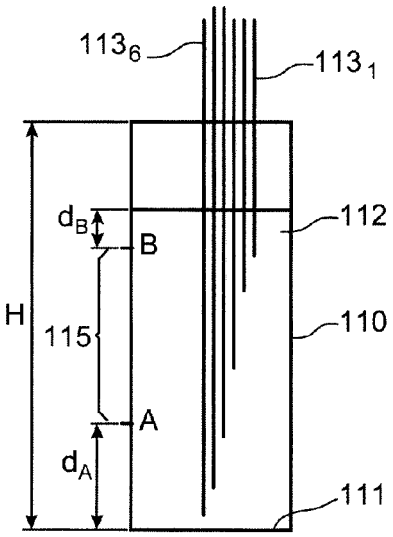

A first experiment is shown in FIG. 3. It was done with white ink containing 10.5% of $TiO_2$ white pigment and 15% binder and various other solids.

One liter of this ink 112 was poured into an 8 cm diameter graduated test tube 110. Therefore the liquid height in the test tube is 20 cm. Six tubes $\mathbf{113}_1$-$\mathbf{113}_6$, each with an inside diameter of 1.1 mm were installed around a fixed stem. These tubes are capable of drawing off ink at different heights: 2, 40, 80, 120, 160, 180 mm from the bottom of the test tube.

The temperature was approximately constant, between 20 and 22° C.

A syringe was used to draw off about 1 $cm^3$ of ink from each of these levels at different times.

The dry extract of each sample was then measured. Knowing that the dry extract is composed of pigment, resins and other non-volatile additives, sedimentation of the pigment can be observed by the increase or decrease in the dry extract. The variation of the pigment content in each drawn off sample can be calculated knowing the ratio of pigment to other solids.

The graph in FIG. 4 shows sedimentation at different heights by the variation of the dry extract in samples. It can be seen that the only sampling points in which there is a variation are the ends. The concentration in the bottom sample (at 2 mm) increases and the concentration in the sample drawn off close to the liquid surface (200−180=20 mm from the surface) reduces.

The concentration for all intermediate samples is constant over the entire measurement period of almost 250 hours. The following interpretation is possible: all pigment particles settle due to their density higher than the density of the liquid surrounding them, at velocities that depend on their size and the viscosity of the medium. At any given point far enough from the bottom or the surface, particles that settle and therefore move towards the bottom of the reservoir are replaced by identical particles that settle at the same velocity from a higher level in the reservoir.

Therefore, depending on the time during which ink remained without stirring, an intermediate zone 115 in the reservoir for example located between a first level A that delimits the lower third or quarter measured as a proportion of the height H of the reservoir, itself measured between the lowest point in the reservoir and the highest point in the reservoir when the reservoir is in operation, and a second level B that delimits the upper third of the upper quarter (once again, measured as a proportion of the height H of the reservoir as explained above). In this zone 115, the concentration of pigment in the ink remains approximately constant throughout the duration of the experiment and equal to a nominal initial concentration.

Consequently, in order to maintain a constant concentration of pigment within a reservoir, an attempt is made to draw off ink near the bottom of the reservoir (for example in the lower third or quarter measured as explained above) where pigments are concentrated due to sedimentation and to move it, for example by pumping it, to bring it to the surface, for example in the upper third or quarter of the reservoir (once again measured as described above), where ink is depleted with pigment. In this way, it is possible to be sure that the ink will be homogeneous over the entire height of the reservoir regardless of the ink height in the reservoir.

Since this reservoir is also designed to supply the print head, ink that is intended for the print head is drawn off from the zone 115 in FIG. 3. This assures that ink sent to the print head is at the nominal or required concentration of pigment, even after ink remained in the reservoir without stirring for a long period, which can be longer than the inactivity period of a printer as used in industry according to prior art.

Distance $d_A$ between firstly the bottom 111 of the reservoir and level A, and distance $d_B$ between the liquid surface and level B, are preferably equal or very similar.

These distances may be calculated from the size grading distribution of pigment in the ink, the pigment density, and the density of the dispersing medium, assuming a Newtonian liquid.

Stokes' law gives this sedimentation velocity of a particle:

$$v = \frac{2 \cdot r^2 g \Delta\rho}{9\eta} = \frac{d^2 g \Delta\rho}{18\eta}$$

v the sedimentation velocity in m/s, r is the radius, and d the diameter of particles in m, g is the gravitation constant 9.81 $m/s^2$, $\Delta\rho$ is the difference in density between the pigment and the liquid medium in $kg/m^3$, $\eta$ is the dynamic viscosity in Pa·s Thus, the distance D traveled between the surface and level B in a given time t considering only the largest particles of pigment that sediment the fastest can be calculated as $D=v \cdot t$.

For example, the sedimentation velocity obtained for titanium oxide particles with a density of 4200 $kg/m^3$ and a diameter of 1 μm contained in an ink in a medium that has a density of 1000 $kg/m^3$ and a viscosity of 5 mPa·s, is 1.3 mm/hour.

The sedimentation velocity for 0.6 μm diameter particles will be 0.45 mm/hour.

Thus, for this latter example, if the reservoir is not stirred for 100 hours, all that is necessary is to draw off ink from more than $d_A$=45 mm from the bottom and more than $d_B$=45 mm from the surface.

We can now understand better that all bottom stirring systems, or systems that draw off liquid from the bottom to discharge it at mid-height of the reservoir or of the liquid stored in the reservoir, will only have a limited effect on the homogeneity of the concentration throughout the liquid volume, unless a lot of energy is spent.

Furthermore, the disadvantage of a flat-bottomed reservoir is that the pigment particles will be deposited over the entire horizontal surface. It will be understood that it becomes more difficult to draw off all sedimented particles to return them to the liquid surface. Document U.S. Pat. No. 6,312,113 confirms this because it recommends a plurality of drawing off branches. And document U.S. Pat. No. 8,371,684 for which the reservoir terminates on a plane surface, shows that the bottom has to be stirred by alternate pumping to limit sedimentation.

Another experiment shown diagrammatically in FIG. 5 was done to measure the quantity of pigment that deposits on a 20 $cm^2$ surface.

In this figure, a receptacle 120 that contains an ink 122 is supported on the base 121 of a weighscale. The reference 123 denotes the measurement tray of the weighscale. A dish 125 with an area of 20 $cm^2$ is immersed in the ink, and collects particles that settle or are deposited. The receptacle is closed by a lid 127 to minimise evaporation effects. This dish 125 is held in place by a stirrup 131 that itself is supported on the tray 123 of the weighscale.

We measured the mass of pigment that settles in the dish 125 as a function of time. The initial settlement velocity of white ink over a 9-hour period was found to be equal to 21.5 mg/hour/20 $cm^2$.

For example, the result for an 8 cm diameter reservoir 120 with an area of 50 $cm^2$ containing such ink will be a deposition rate of 53.75 mg of pigment per hour. Therefore if this ink contains 10% pigment, it will be sufficient to displace 537.5 mg of ink per hour.

The inventor realised that a device capable of collecting all pigment particles that settle to the bottom of the reservoir and moving them or bringing them back to the surface of the liquid at an extremely low flow rate would be sufficient to keep the ink homogeneous throughout the entire reservoir. Therefore this represents a particularly attractive saving in means.

Furthermore, solid particles settle more quickly when they slide on an inclined surface than in a liquid, if the angle between the inclined surface and the horizontal is more than the particle slip angle.

These considerations may be applied to the embodiments disclosed below.

Figure 6A:
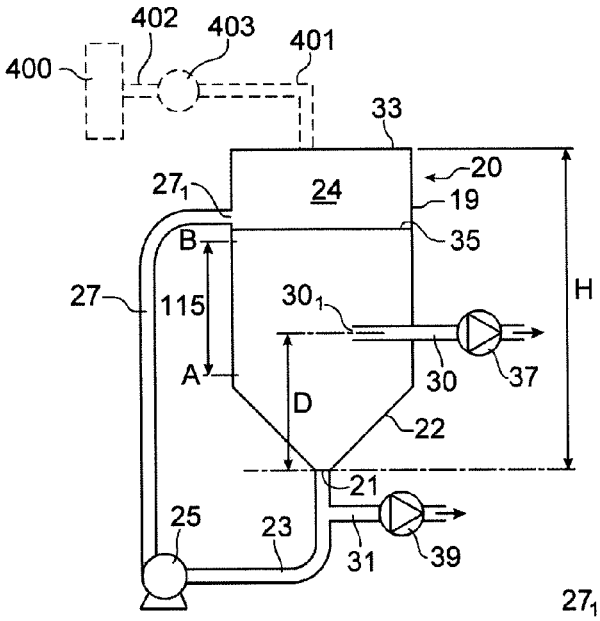
FIGS. 6A-6C show embodiments of a reservoir structure according to this invention.

FIG. 6A shows an example embodiment of an ink reservoir according to the invention, for an ink circuit of a continuous inkjet printer.

A reservoir 20 is delimited by one or more sidewall(s) 19. The bottom 22 is preferably conical and has no horizontal surface or it has an extremely small horizontal surface, so as to accumulate the minimum amount of material. The tip of the cone is oriented towards the bottom of the device along the direction of liquid flow when the reservoir is placed vertically. To satisfy the condition for slip on an inclined surface, the cone angle from the horizontal is chosen such that it is greater than about 30° (and less than 60° or 80°), or less than about 60° (but more than 10° or 30°) from the vertical or the sedimentation direction of pigments.

The example of a part of the reservoir for which the wall is cone-shaped is given herein, but other forms are possible, for example a pyramid shaped wall or more generally a wall tapered or converging towards a portion that comprises an ink flow orifice. The section of the part thus delimited reduces towards this flow orifice.

Such a flow orifice or ink outlet 21 is made in an end part of the reservoir, particularly through the bottom end of the reservoir, in this case formed by the cone tip.

Starting from this outlet, a first pipe or conduit 23 connects a pump 25 to said bottom end. More generally, any device for displacement of ink from the bottom to the top of the reservoir can be used.

A second pipe or conduit 27 connects the outlet from the pump 25 to the top part 24 of the reservoir, for example at a point or outlet orifice above the maximum ink level in the reservoir and therefore above the surface 35 of the ink present in the reservoir which is for example located at 10 mm or 50 mm from the top of the reservoir.

More generally, the height of the reservoir or of the atmosphere situated above the surface 35 of the ink is at least between one third and one fourth of the total height H of the reservoir 20 (H being measured between the lowest point in the reservoir and the highest point in the reservoir when the reservoir is in operation). This avoids any overflow in case of a slight inclination of the reservoir 20.

According to one advantageous embodiment, the top part $\mathbf{27}_1$ of this pipe opens up horizontally so as not to cause a circulation of pigments in the reservoir from the top to the bottom of the reservoir, since such circulation might accelerate their sedimentation. Also preferably, this top part $\mathbf{27}_1$ opens up tangential to the wall of the cylindrical part of the reservoir which facilitates recirculation. The pipe 27 possibly ends at a distributor, for example by dividing into a set of conduits that bring the fluid towards a plurality of outlet points or orifices, preferably above the maximum ink level.

The pump 25 thus provides permanent ink circulation with a flow greater than or equal to the ink sedimentation velocity.

The pump flow does not need to be very high. A reduced or lower flow avoids sedimentation. A flow of the order of 1 ml/hour or even a few milliliters per minute, for example between 1 ml/hour and 5 ml/min or between 1 et 10 ml/min, is sufficient. Therefore there is no need for a powerful pump.

But the pump flow can be, for example, up to 15 l/h or up to 50 l/h.

The pump flow can be increased to mix fresh solvent from a solvent cartridge together with ink, in order to adapt the viscosity of the later.

More generally, solvent (or fresh solvent) can be added to the ink (actually a mixture of ink and solvent) contained in the reservoir at the same time as said ink is recirculated. This additional possibility is schematically illustrated on FIG. 6A, where a hydraulic circuit 400, for example comprising ducts 401, 402 and at least one pump 403, pumps solvent from a cartridge 404 and injects it into the reservoir 20, in its upper part.

Figure 6B:
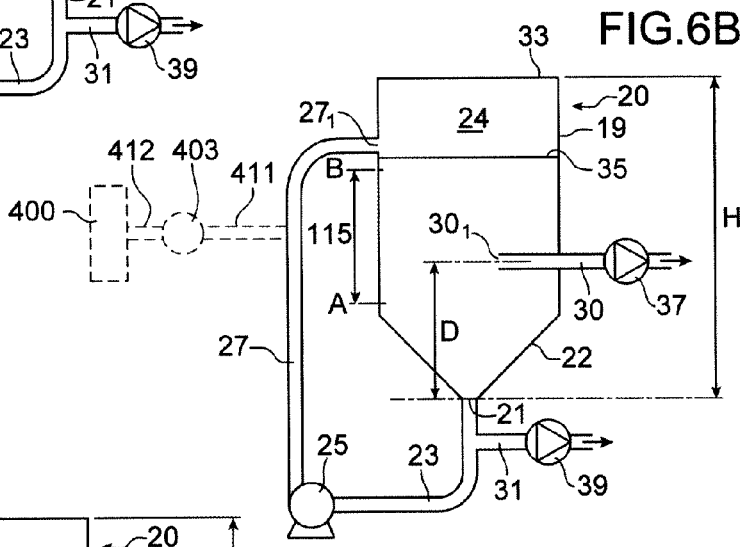

A variant of the device of FIG. 6A is illustrated on FIG. 6B. It is essentially identical to FIG. 6A, the difference from the above being the presence of an injection duct 411 connected to pipe or conduit 27, so that a fluid or a liquid, for example fresh solvent can be added to the recirculated ink, pumped from the bottom of the reservoir, before being injected into the reservoir 20 through top part $\mathbf{27}_1$. The fluid, in particular the fresh solvent, is pumped from a cartridge 400 through one or more pipes or conduits 412. Here again, the flow of pump 25 can be increased to pump both the flow from the bottom of the reservoir 20 but also the flow of added fluid or solvent.

This circulation takes place along a single direction from the bottom of the reservoir to the upper part, preferably above the maximum ink level.

The pump may be a membrane pump type or a peristaltic pump or a geared pump or a centrifugal pump or any other type of pump.

Preferably, it is capable of reaching a flow greater than the pigment sedimentation velocity over the entire surface of the cylindrical part of the reservoir. For example, a flow of more than 0.5 $cm^3$/hour is sufficient for a reservoir for which the largest cross-sectional area is 50 $cm^2$.

The bottom of the reservoir may be pumped from the inside of the reservoir, although it will preferably be pumped from the outside of the reservoir in order to prevent any even minimal pigment retention zone.

Pumping is preferably done permanently, regardless of whether or not the printer is in operation. This possibility is available if the pump 25 is dedicated to the circulation of ink, and is not governed by the operating rate of another function. As a variant, the pump does not operate permanently, provided that the quantity of pigment accumulated at the bottom of the cone during periods during which there is no pumping can be pumped easily afterwards. In all cases, there is no point in providing alternative circulation along either direction, unlike what is disclosed in document U.S. Pat. No. 8,371,684.

The reservoir 20 is provided with means 30 and/or 31 to draw off ink in order to pressurise it and to send it to the print head. Each of these means may be composed of a conduit connected to a pump 37, 39 respectively, so that ink can be sent under pressure to the print head.

This drawing off may be made at a minimum distance d from the bottom of the reservoir and the surface of the liquid in the reservoir, that may for example be calculated using Stokes' law as a function of the size grading of the largest ink pigment particles, the pigment density and the density of the dispersing medium:

$$v = \frac{2 \cdot r^2 g \Delta\rho}{9\eta} = \frac{d^2 g \Delta\rho}{18\eta}$$

where v is the sedimentation velocity in m/s, r is the radius, D is the diameter of particles in m, g is the gravitation constant 9.81 $m/s^2$, $\Delta\rho$ is the difference in density between the pigment and the liquid medium in $kg/m^3$, $\eta$ is the dynamic viscosity in Pa·s, and t is the time, where d=v·t, d is the distance from the lowest point of the reservoir.

A median zone 15 of the reservoir can be defined, for example located between:

- a first level A, defined by the ink flow orifice or by a level located at not less than $1/20^{th}$ or $1/10^{th}$ or ¼ or ⅓ of the reservoir height, measured from its lowest point, as a proportion of the height H of the reservoir (itself measured between the lowest point in the reservoir and the highest point in the reservoir when the reservoir is in operation),
- and a second level B defined by the upper third or quarter (once again measured as a proportion of the height H of the reservoir as explained above). In this zone 115, the concentration of pigment in the ink remains approximately constant and equal to the initial nominal concentration.

One interesting point for the ink sampling point is approximately in the median zone 115 between the ink surface and the outlet orifice 21 located in the bottom of the reservoir. The distance D, measured along the vertical or the pigment sedimentation direction when the reservoir is in use, between the ink drawing off point and the orifice 21, is for example not less than 10 mm, or 20 mm, or 50 mm. The position of this drawing off point $\mathbf{30}_1$ is preferably vertically in line with the orifice 21. It can be determined as a function of physical parameters of the ink (particularly pigment size grading, pigment density, density of the dispersing medium), as explained above. The drawing off location is the location at which pigment concentration will remain nominal or approximately constant, preferably for as long as possible when recycling is not present.

Therefore, we chose a fixed drawing off point in order to maximise the recycling stop time as a function of the machine usage.

With a drawing-off point $\mathbf{30}_1$ positioned such as described above, drawing off may be made at any time without waiting for the recirculation between the bottom of the reservoir and the surface to homogenise the ink over the entire height of the liquid, after the printer is restarted after a rest period. In this way, the printer may be put into operation without delay, at least with a much shorter time than in previous embodiments. Note that the diagram in FIG. 4 indicates remarkable stability of the concentration in the intermediate zone of the reservoir for a duration of more than 150 h, or even 200 h.

Furthermore or as a variant, ink may be drawn off from the recirculation conduit 23 at the bottom of the reservoir to supply the head under pressure. To achieve this, means 31 are used to draw off liquid from this conduit. Drawing off from the conduit 23 can feed the print head even when the ink level in the reservoir is located below means $\mathbf{30}_1$, if there are any.

A device according to the invention may comprise one and/or the other of the drawing off means 30, $\mathbf{30}_1$, 31, each with the corresponding advantages indicated above.

The other functions of a continuous inkjet printer such as return of unused ink may be provided by also discharging ink through the conduit 27 above the free surface of the liquid close to the top of the reservoir.

Figure 6C:
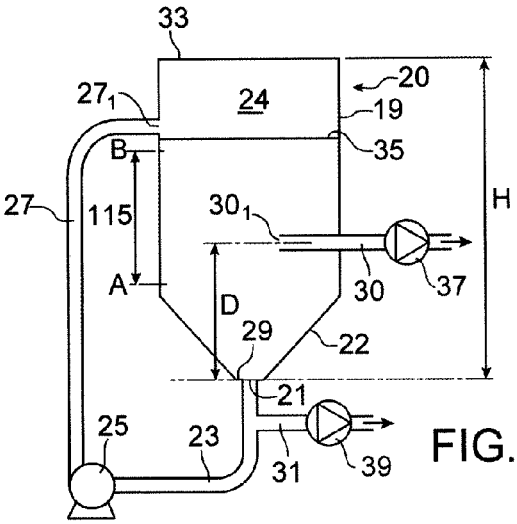
Figure 7A:
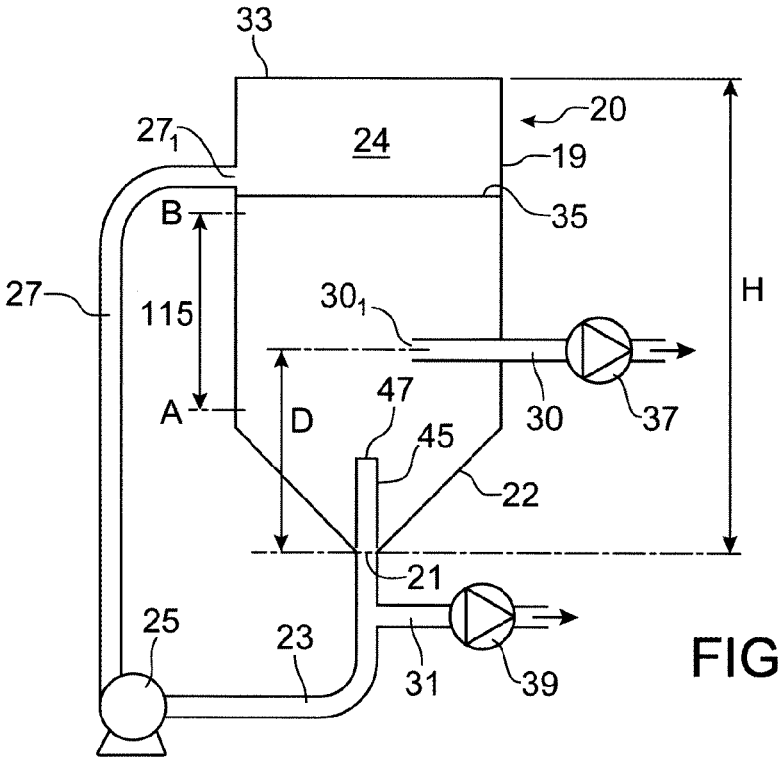
FIGS. 7A, 7B show variant embodiments of a reservoir structure according to this invention, FIG. 8 also shows another variant embodiment of a reservoir structure according to this invention.

FIG. 6C shows a variant of the device that has just been described with reference to FIG. 6A or 6B. It is essentially identical, the difference from the above being the presence of a small plane area 29 at the bottom of the cone: this surface is too small for accumulation to occur at a proportion that would reduce recirculation of the liquid as presented above. Otherwise this embodiment is identical to what was described above FIG. 7A shows another variant of the device described with reference to FIG. 6A. It is essentially identical, the difference being the presence of filter strainer or filter well screen 45 that preferably filters over its entire height. This filter 45 may be placed along the extension of the pipe 23 that draws off ink in order to recirculate it, such that any impurities contained in ink that enters the pipe 23 are removed from it beforehand. Its high point 47 is in the conical part of the reservoir.

In general, a filter may be present in the outlet orifice 21 of the configurations described in this application, particularly with reference to FIG. 6A, 6B, 6C or 8.

Figure 7B:
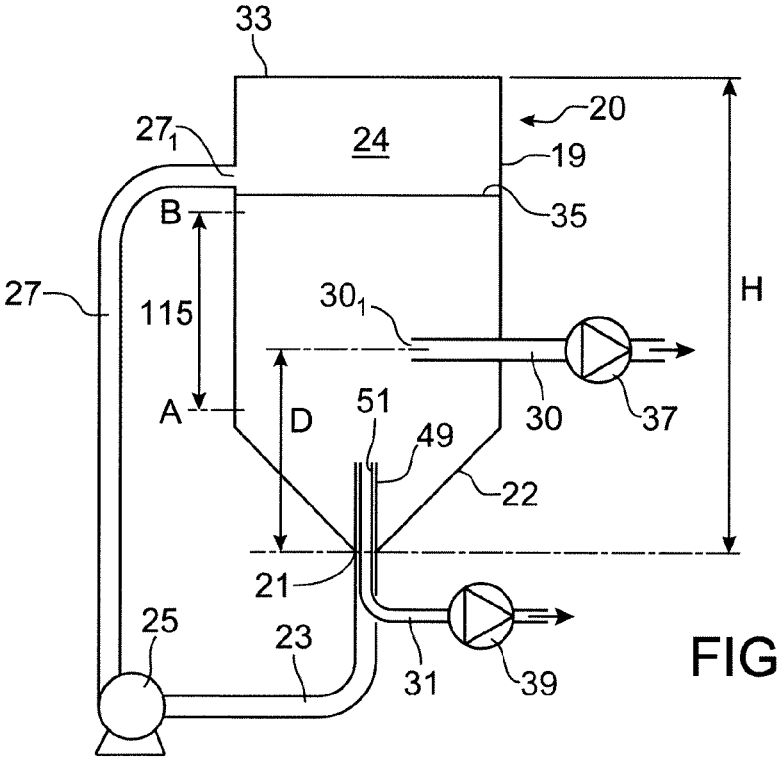

FIG. 7B is another variant of the device described with reference to FIGS. 6A-6C. It is essentially identical, the difference being the presence of a pipe or conduit 51 placed in the extension of the pipe 23 through which ink is drawn off in order to be recirculated. This pipe or conduit 51 is connected to the means 31, 39, arranged in the bottom part of the reservoir: it draws off ink, for example from the conical part of the reservoir in order to inject it into the print head. Consequently, firstly ink that will be recycled and secondly ink that will be sent to the print head are drawn off simultaneously from the conical part of the reservoir. A filter may be present at the end of the pipe or conduit 51.

Figure 8:
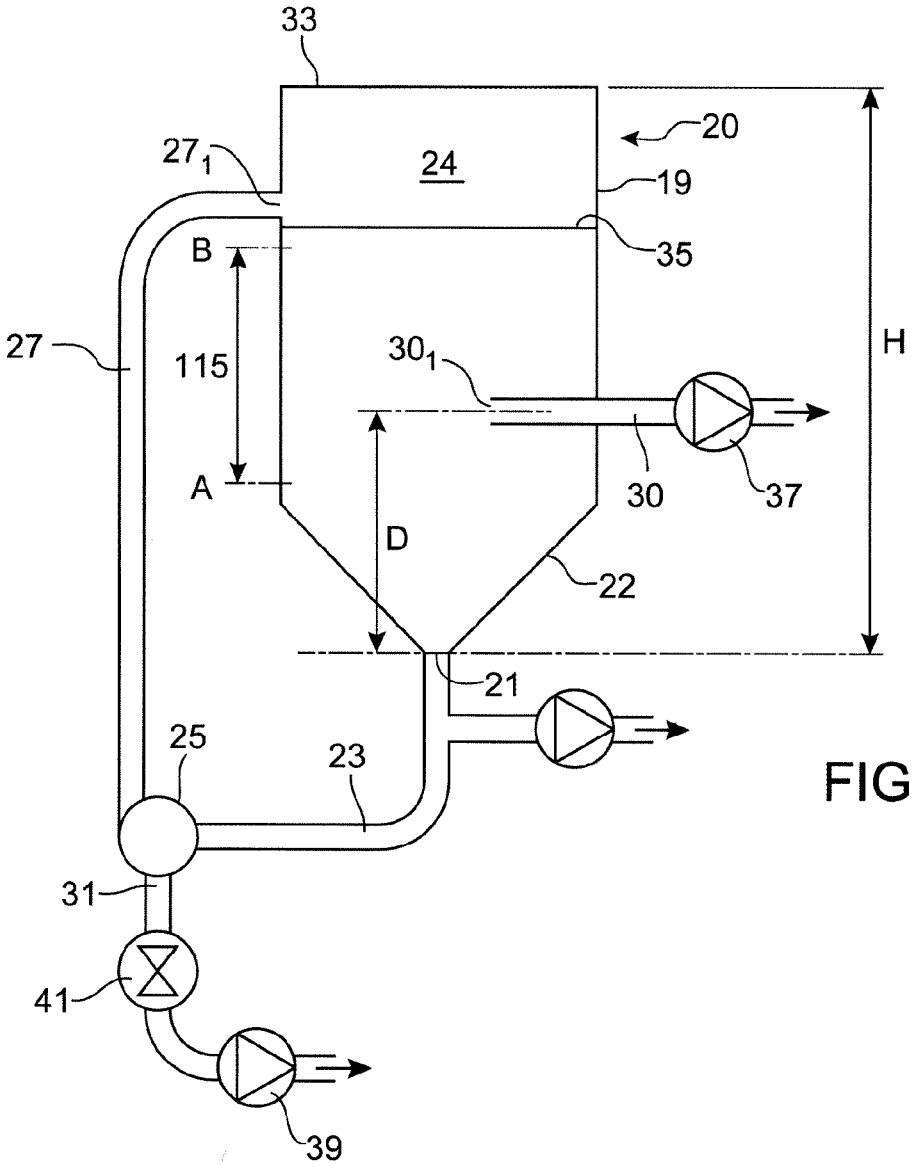

FIG. 8 is another variant of the device described with reference to the FIG. 6A. It is essentially identical, the difference being that the pump 25 not only controls recirculation but also drawing off and sending ink to the print head. Therefore the pump 25 supplies the conduit 31 and creates the pressure necessary for the ink to supply the head. In this case, a valve 41 may be installed on the conduit 31 to allow or to prevent ink being sent to the print head. Ink may only be sent to the print head after it has been homogenised throughout the entire ink reservoir.

The embodiments described above have been disclosed for the case in which the pump and the pipes or conduit 25, 27 are located outside the reservoir 20. However as a variant, it would be possible to position a pump and recycling pipes inside the reservoir itself.

The various embodiments in FIGS. 6A-8 presented above can be combined together.

In particular, the various embodiments in FIGS. 6C-8 can include further means 401-403 or 411, 412, 403, as illustrated on FIGS. 6A and 6B to inject fresh solvent from a cartridge 400.

In the embodiments presented above, the pump 25 is located under a level that passes through the lower part of the reservoir or under this bottom part. This makes sure that it is always pressurised and primed.

Reservoir 20 can have a volume of between, on the one hand, 100 ml or 0.5 l and, on the other hand, 3 l or 5 l.

Figure 1:
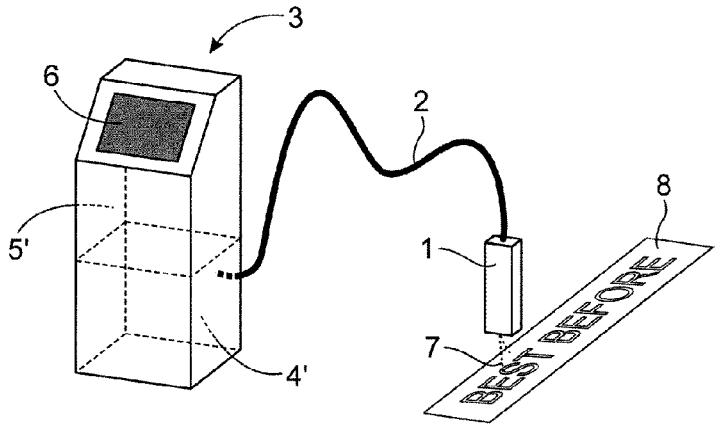
FIG. 1 shows a known printer structure.
Figure 2:
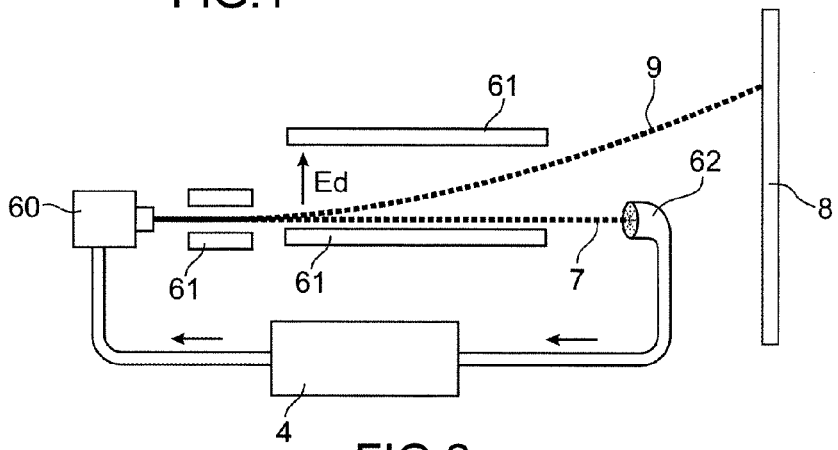
FIG. 2 shows a known structure of a print head of a CIJ type printer.

As illustrated on FIGS. 6A-8, one pump 25 and two ducts 23, 27 can be enough to recirculate the ink from the bottom of the reservoir. The invention is applied to a reservoir of a continuous inkjet printer (CIJ) like that described above with reference to FIGS. 1 and 2.

What is claimed is:

1. Reservoir containing a pigment ink for a continuous inkjet printer comprising:

at least a convergent shaped part, converging towards a portion that comprises an ink flow orifice, the tangent to a wall of said convergent shaped part, in the vertical plane, perpendicular to said wall at, at least, some of its points or at each of its points, forming an angle from the horizontal equal to more than about 30° and less than 90°, when the reservoir is in its usage position, a recirculation circuit to transfer some of the ink from said convergent shaped part, and bring it back into the reservoir, through at least one transferred liquid outlet, located above the maximum ink level in the reservoir, a circuit to draw off ink and transferring the ink thus drawn off to a print head.

2. Reservoir according to claim 1, in which the convergent shaped part is conical or tapered or in the form of a pyramid.

3. Reservoir according to claim 2, said ink flow orifice being located at the vertex or at the end of the conical or tapered or pyramid-shaped wall.

4. Reservoir according to claim 1, the convergent shaped part, having at least one wall that does not have any surface forming an angle of more than 60° with a pigment sedimentation direction when the reservoir is in its usage position.

5. Reservoir according to claim 1, said circuit to draw off some of the ink and transfer it to a print head, being capable of drawing off said ink:

from said convergent shaped part, and/or from an intermediate portion of the reservoir, for example located between:

a first level A, defined by the ink flow orifice or by a level located at not less than $1/20^{th}$ of the height of the reservoir, measured from its lowest point, when the reservoir is in operation, and a second level B defined by the upper third of the reservoir, measured from its highest point, when the reservoir is in operation.

6. Reservoir according to claim 1, said circuit to draw off some of the ink and send it to a print head, being designed so that said ink can be drawn off vertically in line with the ink flow orifice, when the reservoir is in the usage position.

7. Reservoir according to claim 1, wherein the outlet for the transferred ink can bring or return ink back into the reservoir, above or at the surface of the ink present in the reservoir, along a direction perpendicular to a sedimentation direction of ink pigments when the reservoir is in the usage position.

8. Reservoir according to claim 1, comprising a plurality of transferred ink outlets.

9. Reservoir according to claim 1, said recirculation circuit comprising a pump.

10. Reservoir according to claim 9, said pump being single directional.

11. Reservoir according to claim 9, said pump being adapted for pumping at a flow between 0.01 ml/minute and 1 l/minute.

12. Reservoir according to claim 9, said pump making it possible firstly to pump ink from said convergent shaped part, to at least one transferred liquid outlet located above the maximum ink level in the reservoir, when the reservoir is in the usage position, and secondly to draw off some of the ink and transfer the ink thus drawn off to a print head.

13. Reservoir according to claim 1, said circuit to draw off ink and transfer ink thus drawn off to a print head comprising a pump dedicated to this drawing off and transfer.

14. Reservoir according to claim 1, comprising a filter for the drawn off ink.

15. Reservoir according to claim 1, said recirculation circuit being located at least partly outside the reservoir and/or at least partly inside the reservoir.

16. Reservoir according to claim 1, said recirculation circuit enabling a permanent transfer of the ink, even when no jet is ejected by the print head or when the print head is stopped.

17. Reservoir according to claim 1, further comprising an additional circuit to inject an additional fluid into said reservoir, said additional circuit being possibly connected to said recirculation circuit.

18. Continuous inkjet printer comprising:

an ink circuit including a reservoir according to claim 1, a print head, at least one hydraulic connection to bring ink to be printed from the ink reservoir to the print head and to send ink to be recovered from the print head to said ink circuit, an electrical connection to supply power to said print head.

19. Reservoir containing a pigment ink for a continuous inkjet printer comprising:

at least a convergent shaped part, converging towards a portion that comprises an ink flow orifice, the tangent to a wall of said convergent shaped part, in the vertical plane, perpendicular to said wall at, at least, some of its points or at each of its points, forming an angle from the horizontal equal to more than about 30° and less than 90°, when the reservoir is in its usage position, means for transferring some of the ink from said convergent shaped part, and bring it back into the reservoir, through at least one transferred liquid outlet means, located above the maximum ink level in the reservoir, means for drawing off ink and transferring the ink thus drawn off to a print head.

20. Reservoir for a pigment ink for a continuous inkjet printer comprising:

at least a convergent shaped part, converging towards a portion that comprises an ink flow orifice, the tangent to a wall of said convergent shaped part, in the vertical plane, perpendicular to said wall at, at least, some of its points or at each of its points, forming an angle from the horizontal equal to more than about 30° and less than 90°, when the reservoir is in its usage position, a recirculation circuit to transfer some of the ink from said convergent shaped part, and bring it back into the reservoir, through at least one transferred liquid outlet, located above the maximum ink level in the reservoir, a circuit to draw off ink and transferring the ink thus drawn off to a print head wherein said circuit to draw off some of the ink and transfer it to a print head, being capable of drawing off said ink from an intermediate portion of the reservoir, for example located between:

a first level A, defined by the ink flow orifice or by a level located at not less than $1/20^{th}$ of the height of the reservoir, measured from its lowest point, when the reservoir is in operation, and a second level B defined by the upper third of the reservoir, measured from its highest point, when the reservoir is in operation.

21. Reservoir according to claim 20, in which the convergent shaped part is conical or tapered or in the form of a pyramid or has at least one wall that does not have any surface forming an angle of more than 60° with a pigment sedimentation direction when the reservoir is in its usage position.

22. Reservoir according to claim 20, said circuit to draw off some of the ink and send it to a print head, being designed so that said ink can be drawn off vertically in line with the ink flow orifice, when the reservoir is in the usage position.

23. Reservoir according to claim 20, wherein the outlet for the transferred ink can bring or return ink back into the reservoir, above or at the surface of the ink present in the reservoir, along a direction perpendicular to a sedimentation direction of ink pigments when the reservoir is in the usage position.

24. Reservoir according to claim 20, comprising a plurality of transferred ink outlets.

25. Reservoir according to claim 20, said recirculation circuit comprising a pump or a pump being single directional or a pump being adapted for pumping at a flow between 0.01 ml/minute and 1 l/minute or a pump making it possible firstly to pump ink from said convergent shaped part, to at least one transferred liquid outlet located above the maximum ink level in the reservoir, when the reservoir is in the usage position, and secondly to draw off some of the ink and transfer the ink thus drawn off to a print head.

26. Reservoir according to claim 20, said circuit to draw off ink and transfer ink thus drawn off to a print head comprising a pump dedicated to this drawing off and transfer.

27. Reservoir according to claim 20, said recirculation circuit enabling a permanent transfer of the ink, even when no jet is ejected by the print head or when the print head is stopped.

28. Reservoir according to claim 20, further comprising an additional circuit to inject an additional fluid into said reservoir, said additional circuit being possibly connected to said recirculation circuit.

29. Continuous inkjet printer comprising:

an ink circuit including a reservoir according to claim 20, a print head, at least one hydraulic connection to bring ink to be printed from the ink reservoir to the print head and to send ink to be recovered from the print head to said ink circuit, an electrical connection to supply power to said print head.

* * * * *